US009133734B2

(12) United States Patent
Kato et al.

(10) Patent No.: US 9,133,734 B2
(45) Date of Patent: Sep. 15, 2015

(54) VALVE TIMING CONTROL APPARATUS FOR INTERNAL COMBUSTION ENGINE

(75) Inventors: Hiroyuki Kato, Kanagawa (JP); Shinichi Sato, Atsugi (JP)

(73) Assignee: HITACHI AUTOMOTIVE SYSTEMS, LTD., Hitachiaka-Shi (JP)

( * ) Notice: Subject to any disclaimer, the term of this patent is extended or adjusted under 35 U.S.C. 154(b) by 0 days.

(21) Appl. No.: 13/611,846

(22) Filed: Sep. 12, 2012

(65) Prior Publication Data

US 2013/0180481 A1 Jul. 18, 2013

(30) Foreign Application Priority Data

Jan. 17, 2012 (JP) ..... 2012-006655

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/3443* (2013.01); *F01L 2001/34423* (2013.01); *F01L 2001/34453* (2013.01); *F01L 2001/34466* (2013.01); *F01L 2001/34476* (2013.01)

(58) Field of Classification Search
CPC . F01L 1/34; F01L 1/3442; F01L 2001/34423; F01L 2001/34476; F01L 2001/34453; F01L 2001/34466; F01L 2001/3443
USPC ..... 123/90.15, 90.17
See application file for complete search history.

(56) References Cited

U.S. PATENT DOCUMENTS

| | | | | |
|---|---|---|---|---|
| 7,841,311 | B2 * | 11/2010 | Hutcheson et al. | 123/90.17 |
| 8,297,244 | B2 * | 10/2012 | Hoppe et al. | 123/90.17 |
| 2002/0017255 | A1 * | 2/2002 | Ogawa | 123/90.15 |
| 2003/0121485 | A1 | 7/2003 | Strauss | |
| 2009/0250028 | A1 | 10/2009 | Fujiyoshi et al. | |
| 2010/0319641 | A1 * | 12/2010 | Suzuki et al. | 123/90.17 |
| 2011/0088645 | A1 * | 4/2011 | Yamaguchi et al. | 123/90.17 |
| 2013/0019826 | A1 * | 1/2013 | Nakashima | 123/90.15 |
| 2013/0104822 | A1 * | 5/2013 | Dupuis et al. | 123/90.17 |
| 2013/0146005 | A1 * | 6/2013 | Watanabe | 123/90.15 |

FOREIGN PATENT DOCUMENTS

| | | | |
|---|---|---|---|
| JP | 2003-201810 | A | 7/2003 |
| JP | 2009-250073 | A | 10/2009 |
| JP | 2011-085074 | A | 4/2011 |
| WO | WO 2009071458 | A2 * | 6/2009 |

* cited by examiner

*Primary Examiner* — Zelalem Eshete
(74) *Attorney, Agent, or Firm* — Foley & Lardner LLP

(57) ABSTRACT

A valve timing control apparatus including a housing, a vane rotor rotatable relative to the housing toward a phase-advance side and a phase-retard side, a first lock member and a second lock member disposed on the vane rotor, a first lock concave portion disposed on the housing so as to be engaged with a tip end portion of the first lock member, a second lock concave portion disposed on the housing so as to be engaged with a tip end portion of the second lock member, and a communication passage formed in the vane rotor and serving to always establish fluid communication between the first and second lock concave portions.

16 Claims, 8 Drawing Sheets

VALVE TIMING CONTROL APPARATUS FOR INTERNAL COMBUSTION ENGINE

BACKGROUND OF THE INVENTION

The present invention relates to a valve timing control apparatus for an internal combustion engine which variably controls timings of opening and closing an engine valve (i.e., an intake valve and an exhaust valve) during an engine operation.

There has been proposed a so-called vane type valve timing control apparatus for an internal combustion engine.

Japanese Patent Application Unexamined Publication No. 2011-85074 discloses such a vane type valve timing control apparatus. The valve timing control apparatus of this conventional art is constructed such that when starting an engine, timings of opening and closing an intake valve is held in an intermediate phase position between a maximum phase-retard position and a maximum phase-advance position by using a lock pin to thereby enhance startability of the engine. In a case where such a lock pin is moved to an unlock position, it is preferable to allow the lock pin to retreat without adverse influence of a hydraulic pressure in a phase-advance hydraulic chamber or a hydraulic pressure in a phase-retard hydraulic chamber. For this reason, in the valve timing control apparatus of the conventional art, a large-diameter flange is integrally formed on an outer periphery of the lock pin and undergoes a hydraulic pressure to thereby move the lock pin to retreat to the unlock position.

SUMMARY OF THE INVENTION

However, in the valve timing control apparatus of the above conventional art, the retreat movement of the lock pin must be constructed through the flange portion integrally formed on the outer periphery of the lock pin. Therefore, it is necessary to ensure a large space for accommodating the lock pin, thereby causing limitation in layout.

It is an object of the present invention to solve the above-described technological problem in the conventional art and provide a valve timing control apparatus for an internal combustion engine which is capable of minimizing a size of a lock pin to be locked in an intermediate phase position between a maximum phase-retard position and a maximum phase-advance position, thereby enhancing a freedom of layout of the valve timing control apparatus in the engine.

In one aspect of the present invention, there is provided a valve timing control apparatus for an internal combustion engine, including:

a housing to which a rotational force is transmitted from a crankshaft of the engine, the housing having shoes on an inner periphery thereof, a vane rotor fixed to a camshaft, the vane rotor cooperating with the shoes to define phase-advance hydraulic chambers and phase-retard hydraulic chambers therebetween, the vane rotor being rotatable relative to the housing toward a phase-advance side and a phase-retard side by a working fluid pressure that is selectively supplied to the phase-advance hydraulic chambers and the phase-retard hydraulic chambers and discharged therefrom, a first lock member and a second lock member respectively disposed on the vane rotor, the first lock member and the second lock member being urged to project toward a side of the housing by a biasing member and allowed to retreat against a biasing force of the biasing member by a hydraulic pressure that acts on a tip end portion of each of the first lock member and the second lock member, the hydraulic pressure being supplied separately from the working fluid pressure selectively supplied to the phase-advance hydraulic chambers and the phase-retard hydraulic chambers, a first lock concave portion disposed on the housing so as to be engaged with a tip end portion of the first lock member and restrain the vane rotor from being rotated from an intermediate phase position between a maximum phase-advance position and a maximum phase-retard position at least in a phase-advance direction;

a second lock concave portion disposed on the housing so as to be engaged with a tip end portion of the second lock member and restrain the vane rotor from being rotated from the intermediate phase position between the maximum phase-advance position and the maximum phase-retard position at least in a phase-retard direction; and a communication passage formed in the vane rotor so as to extend along a circumferential direction of the vane rotor, the communication passage serving to always establish fluid communication between the first lock concave portion and the second lock concave portion and introduce the hydraulic pressure to allow the first lock member and the second lock member to retreat from the first lock concave portion and the second lock concave portion against the biasing force of the biasing member, wherein when the vane rotor is rotationally moved between the maximum phase-advance position and the maximum phase-retard position, the fluid communication between the first lock concave portion and the second lock concave portion is kept through the communication passage.

In a further aspect of the present invention, there is provided a valve timing control apparatus for an internal combustion engine, including:

a housing to which a rotational force is transmitted from a crankshaft of the engine, the housing having shoes on an inner periphery thereof, a vane rotor fixed to a camshaft, the vane rotor cooperating with the shoes to define phase-advance hydraulic chambers and phase-retard hydraulic chambers therebetween, the vane rotor being rotatable relative to the housing toward a phase-advance side and a phase-retard side by a working fluid pressure that is selectively supplied to the phase-advance hydraulic chambers and the phase-retard hydraulic chambers and discharged therefrom, a lock mechanism disposed on the vane rotor, the lock mechanism being constructed to lock the vane rotor relative to the housing in an intermediate phase position between a maximum phase-advance position and a maximum phase-retard position by a biasing member and unlock the vane rotor against a biasing force of the biasing member by a hydraulic pressure supplied separately from the working fluid pressure selectively supplied to the phase-advance hydraulic chambers and the phase-retard hydraulic chambers, and a communication passage through which a hydraulic pressure to unlock the vane rotor is kept introduced to the lock mechanism when the vane rotor is rotationally moved between the maximum phase-advance position and the maximum phase-retard position.

In a still further aspect of the present invention, there is provided a valve timing control apparatus for an internal combustion engine, including:

a drive rotation member to which a rotational force is transmitted from a crankshaft of the engine;

a driven rotation member fixed to a camshaft, the driven rotation member cooperating with the drive rotation member to define phase-advance hydraulic chambers and phase-retard hydraulic chambers therebetween, the driven rotation member being rotatable relative to the drive rotation member toward a phase-advance side and a phase-retard side by a working fluid pressure that is selectively supplied to the phase-advance hydraulic chambers and the phase-retard hydraulic chambers and discharged therefrom, a lock member disposed on the driven rotation member, the lock member being urged to project toward a side of the drive rotation member by a biasing member and allowed to retreat against a biasing force of the biasing member by a hydraulic pressure that acts on a tip end portion of the lock member, the hydraulic pressure being supplied separately from the working fluid pressure selectively supplied to the phase-advance hydraulic chambers and the phase-retard hydraulic chambers, a lock concave portion disposed on the drive rotation member so as to be engaged with a tip end portion of the lock member and restrain the driven rotation member from being rotated from an intermediate phase position between a maximum phase-advance position and a maximum phase-retard position in at least a phase-retard direction; and a communication passage serving to introduce a hydraulic pressure to hold the lock member in a retreat state to the lock concave portion when the driven rotation member is rotationally moved from the maximum phase-retard position to the maximum phase-advance position.

The valve timing control apparatus for an internal combustion engine, according to the present invention, can enhance a freedom of layout in the engine by using a lock pin having a minimum size which is locked in an intermediate phase position between a maximum phase-retard position and a maximum phase-advance position.

Other objects and features of this invention will become understood from the following description with reference to the accompanying drawings.

DETAILED DESCRIPTION OF THE INVENTION

Figure 1:
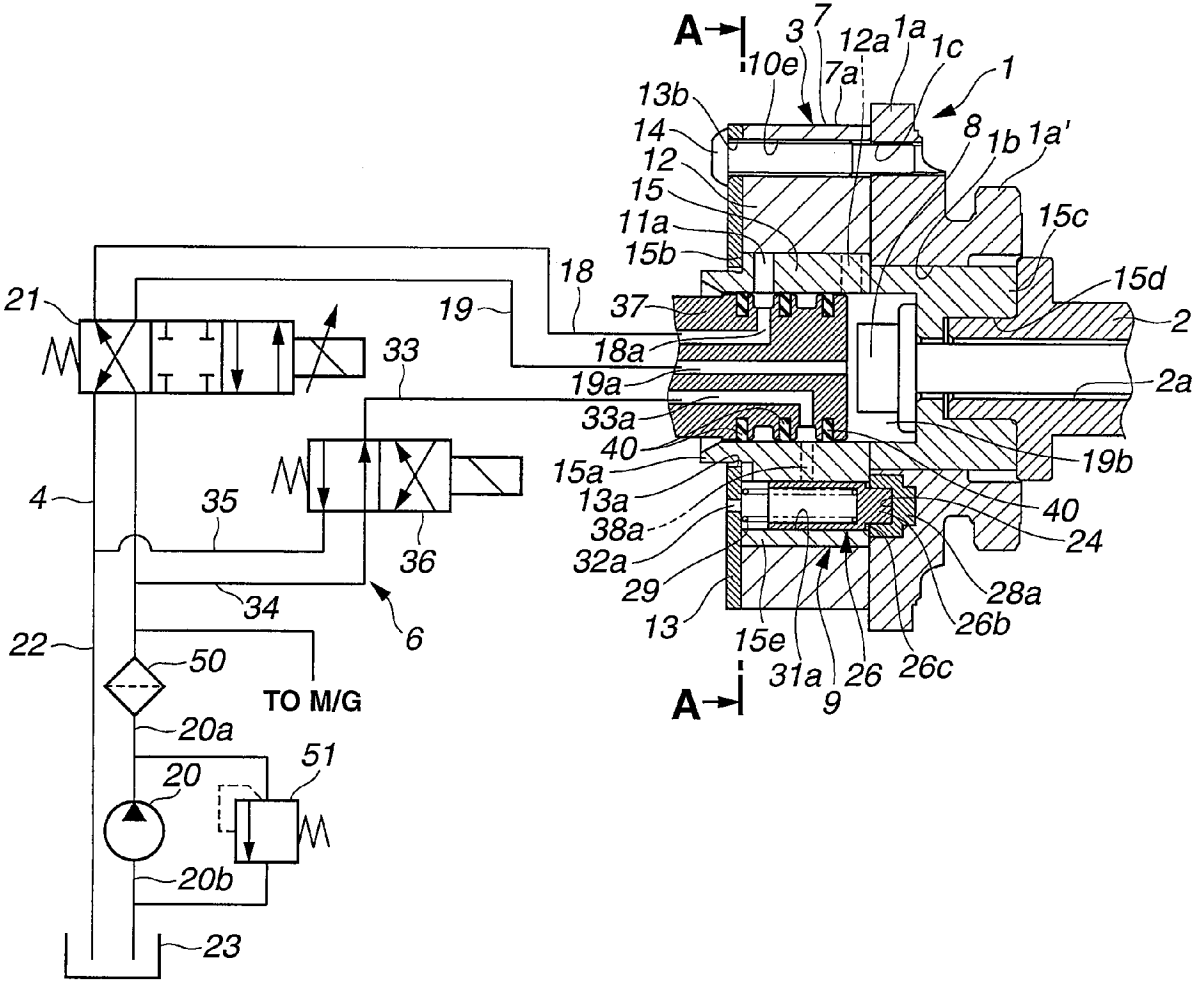
FIG. 1 is a diagram showing a general construction of a valve timing control apparatus according to a first embodiment of the present invention, which is shown partly in cross-section.

In the following, a valve timing control apparatus according to embodiments of the present invention is described with reference to the drawings. In the respective embodiments, the valve timing control apparatus is applied to a side of an intake valve of an internal combustion engine. For ease of understanding, directional terms, such as "upper", "upward", "lower", "downward", etc. are used in the following description, but merely denote directions as viewed in the drawings.

First Embodiment

Figure 2:
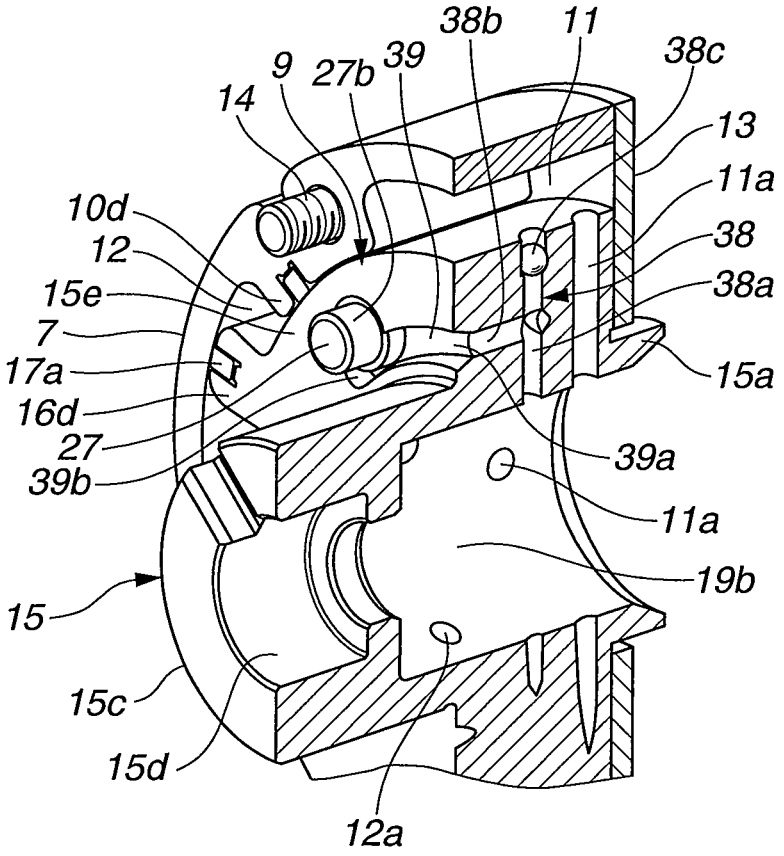
FIG. 2 is a perspective cross-section of a vane rotor housing of the valve timing control apparatus according to the embodiment, which shows a construction of hydraulic passages.
Figure 3:
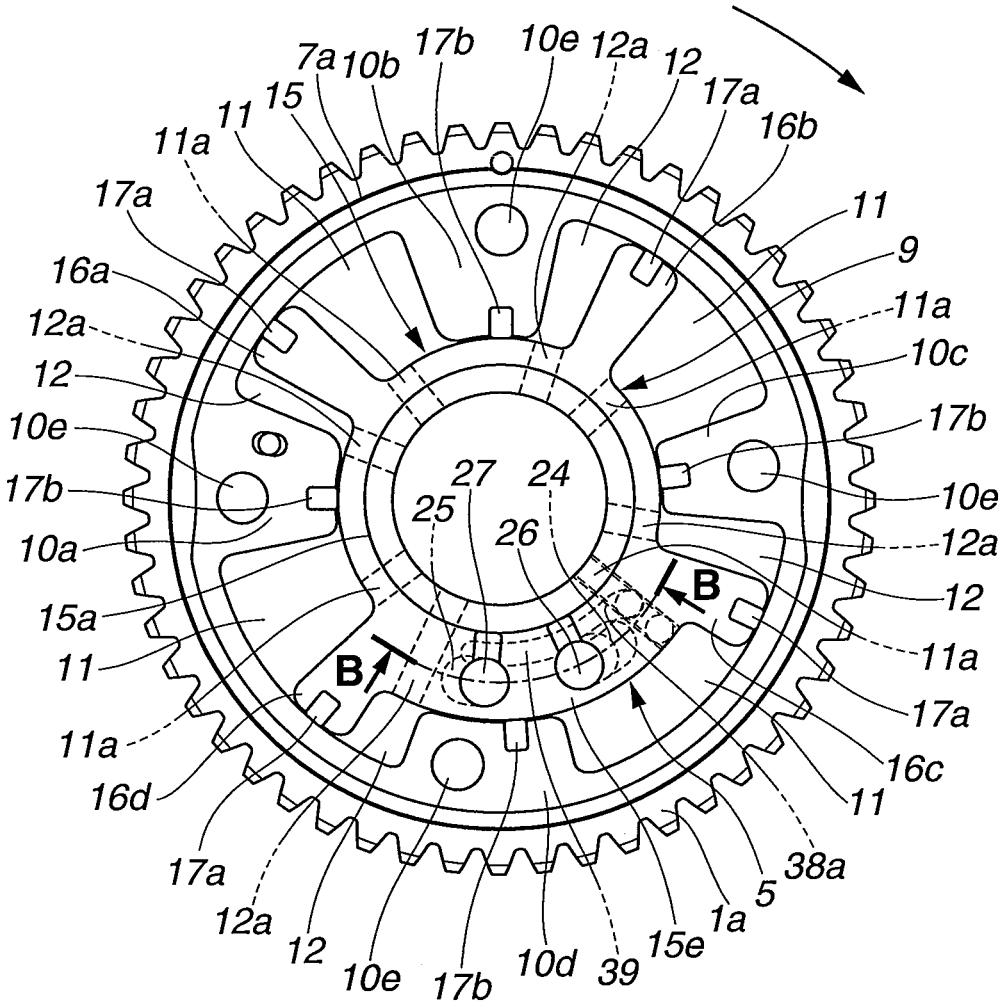
FIG. 3 is a cross-section taken along line A-A shown in FIG. 1, which shows a vane rotor held in an intermediate phase position.
Figure 4:
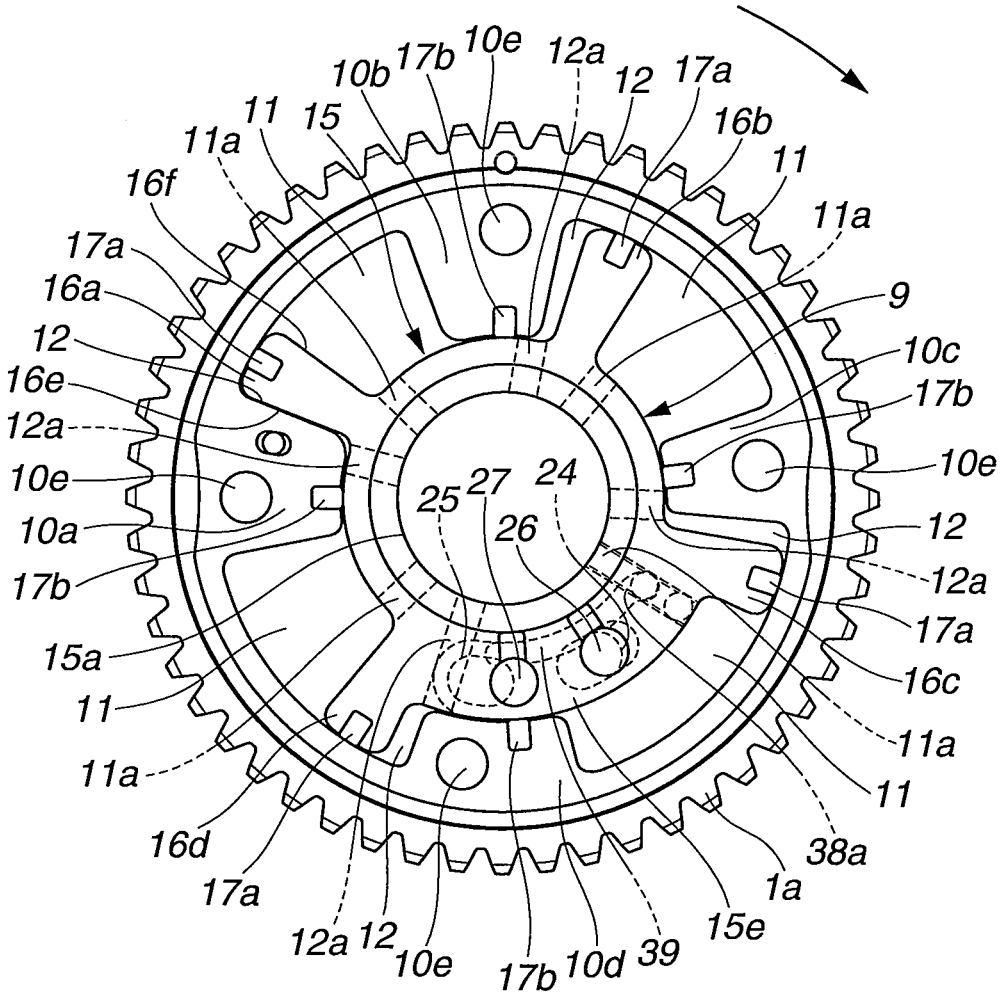
FIG. 4 is a cross-section taken along line A-A shown in FIG. 1, which shows the vane rotor held in a maximum phase-retard position.
Figure 5:
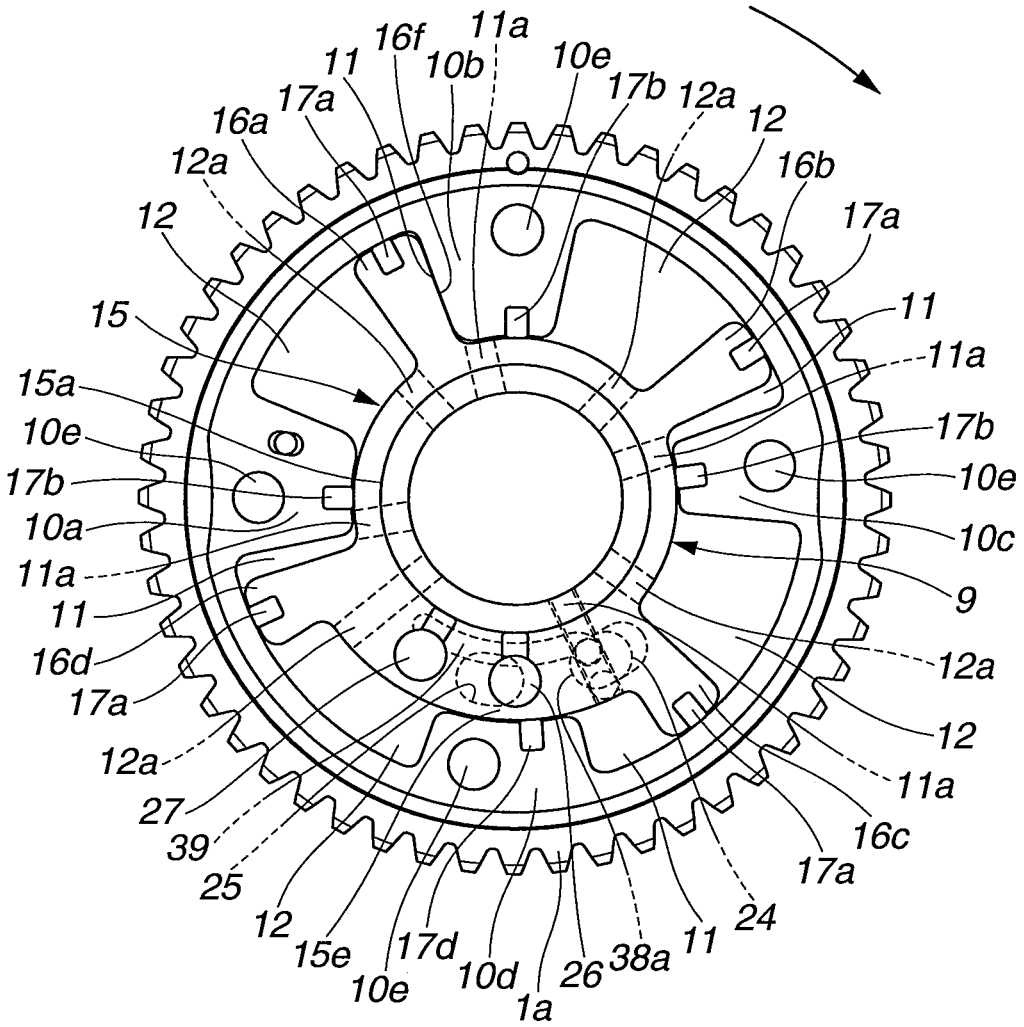
FIG. 5 is a cross-section taken along line A-A shown in FIG. 1, which shows the vane rotor held in a maximum phase-advance position.

Referring to FIG. 1 to FIG. 10, there is shown a valve timing control apparatus according to a first embodiment of the present invention. As shown in FIG. 1, valve timing control apparatus 100 includes sprocket 1 as a drive rotation member, intake-side camshaft 2 disposed to be rotatable relative to timing sprocket 1, phase varying mechanism 3 disposed between sprocket 1 and intake-side camshaft 2 and serving to vary a relative rotational phase thereof, first hydraulic circuit 4 that serves to operate phase varying mechanism 3, position holding mechanism (i.e., lock mechanism) 5 that holds a rotational position of camshaft 2 relative to sprocket 1 in a predetermined intermediate phase position between a maximum phase-retard position and a maximum phase-advance position through phase varying mechanism 3, and second hydraulic circuit 6 that serves to operate position holding mechanism 5. Sprocket 1 is rotationally driven by a crankshaft of the engine through a timing chain. Intake-side camshaft 2 is arranged along a fore-and-aft direction of the engine. The predetermined intermediate phase position is shown in FIG. 3. The maximum phase-retard position is shown in FIG. 4. The maximum phase-advance position is shown in FIG. 5.

Sprocket 1 is formed into a disk shape having a large thickness, and has a large-diameter gear portion 1*a* and a small-diameter gear portion 1*a*' on an outer periphery thereof, on which the timing chain and a chain for an auxiliary engine are wound, respectively. Sprocket 1 also serves as a rear cover that covers an opening of a rear end of housing 7 of phase varying mechanism 3 as explained later. Sprocket 1 has support hole 1*b* that extends through a central portion of sprocket 1. Sprocket 1 is rotatably supported on an outer periphery of vane rotor 9 through support hole 1*b*. Vane rotor 9 is fixed onto camshaft 2. Sprocket 1 also has four female tapped holes 1*c* on the outer periphery thereof (see FIG. 3). Female tapped holes 1*c* are spaced apart from each other in a circumferential direction of sprocket 1, into which bolts 14 are respectively screwed as explained later.

Camshaft 2 is rotatably supported on a cylinder head (not shown) through a camshaft bearing (not shown). Camshaft 2 has a plurality of cams on an outer peripheral surface thereof which are integrally formed with camshaft 2 and arranged in predetermined positions in an axial direction of camshaft 2. Camshaft 2 has female tapped hole 2*a* at one end portion thereof which is open to one end surface of camshaft 2 and extends in the axial direction of camshaft 2.

As shown in FIG. 1 and FIG. 3, phase varying mechanism 3 is connected to sprocket 1 in an axial direction of sprocket 1. Phase varying mechanism 3 includes housing 7, vane rotor 9 as a driven rotation member which is disposed within housing 7 so as to be rotatable relative to housing 7, and four phase-retard hydraulic chambers 11 and four phase-advance hydraulic chambers 12 which are working fluid chambers defined within housing 7. Vane rotor 9 is fixed to camshaft 2 through cam bolt 8 screwed into female tapped hole 2*a* of the one end portion of camshaft 2. Phase-retard hydraulic chambers 11 and phase-advance hydraulic chambers 12 are defined by vane rotor 9 and four shoes (i.e., a first shoe to a fourth shoe) 10*a*-10*d* formed on an inner peripheral surface of housing 7.

Housing 7 includes cylindrical housing body 7*a*, front cover 13 that covers a front end opening of housing body 7*a*, and sprocket 1 serving as a rear cover that covers a rear end opening of housing body 7*a*. Housing body 7*a* is made of a sintered metal material. Front cover 13 is formed by pressing. Housing body 7*a*, front cover 13 and sprocket 1 are fixed to each other through four bolts 14 respectively extending through bolt insertion holes 10*e* of four shoes 10*a*-10*d*. Front cover 13 has rotor insertion hole 13*a* at a central portion thereof through which seal member insertion guide portion 15*a* of rotor 15 extends as explained later. Front cover 13 also has four bolt insertion holes 13*b* formed in an outer peripheral portion of front cover 13 in a spaced relation to each other in a circumferential direction of front cover 13. Rotor insertion hole 13*a* and bolt insertion holes 13*b* extend through front cover 13.

Vane rotor 9 is integrally formed of a metal material. Vane rotor 9 includes rotor 15 fixed to the one end portion of camshaft 2 by cam bolt 8, and four vanes (i.e., a first vane to a fourth vane) 16*a*-16*d* formed on an outer periphery of rotor 15. First vane 16*a* to fourth vane 16*d* outwardly extend from an outer peripheral surface of rotor 15 in a radial direction of rotor 15, and are spaced apart from each other at angular intervals of about 120 degrees in a circumferential direction of rotor 15.

Rotor 15 is formed into a generally cylindrical shape elongated in the fore-and-aft direction of the engine and has an insertion hole into which one end portion of passage construction member 37 is inserted as explained later. Rotor 15 includes insertion guide portion 15*a* located in a substantially central part of front end surface 15*b* of rotor 15, and hub portion 15*c* located on a rear side of rotor 15. Insertion guide portion 15*a* is formed into a cylindrical shape having a small thickness, and integrally formed with rotor 15. Hub portion 15*c* extends toward camshaft 2, and is integrally formed with rotor 15. Hub portion 15*c* has cylindrical engaging bore 15*d* to which the one end portion of camshaft 2 is fitted. The insertion hole of rotor 15 extends into hub portion 15*c* through insertion guide portion 15*a* along an axial direction of rotor 15.

As shown in FIG. 3 to FIG. 5, first to fourth vanes 16*a*-16*d* are disposed between adjacent two of shoes 10*a*-10*d*, respectively. Vanes 16*a*-16*d* are constructed to have a same width in the circumferential direction of rotor 15. Each of vanes 16*a*-16*d* has a seal groove on an arcuate outer peripheral surface thereof into which seal member 17*a* is fitted. Seal member 17*a* slidably moves on an inner peripheral surface of housing body 7*a* to seal a clearance between the inner peripheral surface of housing body 7*a* and the outer peripheral surface of each of vanes 16*a*-16*d*. On the other hand, each of shoes 10*a*-10*d* has a seal groove on an inner peripheral surface of a tip end thereof. Seal member 17*b* is fitted into the seal groove, and slidably moves on an outer peripheral surface of rotor 15 to seal a clearance between the outer peripheral surface of rotor 15 and the inner peripheral surface of each of shoes 10*a*-10*d*.

As shown in FIG. 4, when vane rotor 9 is rotated relative to housing 7 toward the maximum phase-retard side and reaches the maximum phase-retard position, one side surface 16*e* of first vane 16*a* in a circumferential direction of vane rotor 9 is contacted with one side surface of first shoe 10*e* in a circumferential direction of housing 7 which is opposed to one side surface 16*e*, so that the rotation of vane rotor 9 toward the maximum phase-retard side is restrained. In contrast, as shown in FIG. 5, when vane rotor 9 is rotated relative to housing 7 toward the maximum phase-advance side and reaches the maximum phase-advance position, the other side surface 16*f* of first vane 16*a* in the circumferential direction of vane rotor 9 is contacted with one side surface of second shoe 10*b* in the circumferential direction of housing 7 which is opposed to the other side surface 16*f*, so that the rotation of vane rotor 9 toward the maximum phase-advance side is restrained. Thus, first vane 16*a*, first shoe 10*a* and second shoe 10*b* cooperate with each other to serve as a stop to restrain the rotation of vane rotor 9 toward the maximum phase-retard side and the rotation of vane rotor 9 toward the maximum phase-advance side.

At this time, both side surfaces of each of second to fourth vanes 16*b*-16*d* are spaced in a circumferential direction of vane rotor 9 apart from a side surface of each of adjacent two shoes between which each of second to fourth vanes 16*b*-16*d* is disposed. For example, as shown in FIG. 4 and FIG. 5, a left side surface of second vane 16*b* is spaced apart from a right side surface of second shoe 10*b*, and a right side surface of second vane 16*b* is spaced apart from a left side surface of third shoe 10*c*. Accordingly, accuracy of the contact between vane rotor 9 and respective shoes 10*a*-10*d* can be enhanced. Further, speed of supplying a hydraulic pressure to respective hydraulic chambers 11, 12 can be increased to thereby enhance a response in switching between positive rotation and reverse rotation of vane rotor 9.

Further, rotor 15 includes large-diameter portion 15*e* disposed between third vane 16*c* and fourth vane 16*d* and integrally formed with rotor 15. Large-diameter portion 15*e* is formed to connect the side surfaces of vanes 16*c*, 16*d* which are opposed to each other in the circumferential direction of rotor 15. Large-diameter portion 15*e* is formed into a sector shape centered at an axis of rotor 15, and has a substantially uniform radial length extending up to a substantially middle position of third and fourth vanes 16*c*, 16*d* in the phase-retard hydraulic chamber 11 and phase-advance hydraulic chamber 12, respectively, in a radial direction of rotor 15.

Four phase-retard hydraulic chambers 11 and four phase-advance hydraulic chambers 12 which serve as working fluid chambers are respectively defined between one of the both side surfaces of respective vanes 16*a*-16*d* and one of the both side surfaces of respective shoes 10*a*-10*d* which is opposed to the one side surface of respective vanes 16*a*-16*d* on a preceding side and a following side in both a positive rotation direction of vane rotor 9 and a reverse rotation direction thereof. Respective phase-retard hydraulic chambers 11 and respective phase-advance hydraulic chambers 12 are communicated with first hydraulic circuit 4 through first communication hole 11*a* and second communication hole 12*a* which are formed in rotor 15 along a substantially radial direction of rotor 15, respectively.

First hydraulic circuit 4 serves to selectively supply a working fluid (a hydraulic pressure) to respective phase-retard hydraulic chambers 11 and respective phase-advance hydraulic chambers 12 and discharge the working fluid therefrom. As shown in FIG. 1, first hydraulic circuit 4 includes phase-retard fluid passage 18, phase-advance fluid passage 19 and first electromagnetic valve 21. First hydraulic circuit 4 is connected to oil pump 20 and drain passage 22. Oil pump 20 serves as a fluid pressure supply source which supplies the working fluid to respective fluid passages 18, 19. Oil pump 20 may be of a generally known type such as a trochoid pump that is rotationally driven by a crankshaft of an engine. First electromagnetic valve 21 is operated to carry out selective changeover of fluid communication between oil pump 20 and one of fluid passages 18, 19 and fluid communication between drain passage 22 and the other of fluid passages 18, 19 in accordance with an operating condition of the engine. Phase-retard fluid passage 18 serves to supply the hydraulic pressure discharged from oil pump 20 to respective phase-retard hydraulic chambers 11 through first communication hole 11*a* and discharge the hydraulic pressure in respective phase-retard hydraulic chambers 11 through first communication hole 11*a*. Phase-advance fluid passage 19 serves to supply the hydraulic pressure discharged from oil pump 20 to respective phase-advance hydraulic chambers 12 through second communication hole 12*a* and discharge the hydraulic pressure in respective phase-advance hydraulic chambers 12 through second communication hole 12*a*.

Phase-retard fluid passage 18 has phase-retard passage portion 18*a* on a side of one end thereof, and is connected to first electromagnetic valve 21 at the other end thereof. Phase-advance fluid passage 19 has phase-advance passage portion 19*a* on a side of the other end thereof, and is connected to first electromagnetic valve 21 at the other end thereof. Phase-retard passage portion 18*a* and phase-advance passage portion 19*a* are formed in the generally cylindrical one end portion of passage construction member 37 which is inserted into the insertion hole of rotor 15 through insertion guide portion 15*a* and held in the insertion hole. Phase-retard passage portion 18*a* extends to form a generally L-shape in section as shown in FIG. 1, and has an open end opened to an outer peripheral surface of passage construction member 37. Phase-advance passage portion 19*a* extends in an axial direction of passage construction member 37, and has an open end opened to an axial end surface of passage construction member 37 as shown in FIG. 1. Phase-retard passage portion 18*a* is communicated with respective phase-retard hydraulic chambers 11 through first communication hole 11*a* extending through rotor 15 in the radial direction of rotor 15. On the other hand, phase-advance passage portion 19*a* is communicated with respective phase-advance hydraulic chambers 12 through fluid chamber 19*b* formed on a side of a head of cam bolt 8 and second communication hole 12*a* extending through rotor 15 in the radial direction of rotor 15.

Passage construction member 37 is formed as a non-rotation member fixed to a chain cover (not shown) at an outer end portion thereof. Passage construction member 37 includes phase-retard passage portion 18*a*, phase-advance passage portion 19*a*, and a passage of second hydraulic circuit 6 which serve to unlock position holding mechanism 5 as explained later.

As shown in FIG. 1, first electromagnetic valve 21 is a four-port three-position proportional control valve. First electromagnetic valve 21 is controlled by an electronic controller (not shown) such that a spool slidably disposed in a valve body in an axial direction of the valve body is moved in the axial direction so as to communicate discharge passage 20*a* of oil pump 20 with one of phase-retard fluid passage 18 and phase-advance fluid passage 19 and communicate the other of phase-retard fluid passage 18 and phase-advance fluid passage 19 with drain passage 22.

Suction passage 20*b* of oil pump 20 and drain passage 22 are communicated with oil pan 23. Filter 50 is disposed on a downstream side of discharge passage 20*a* of oil pump 20. Discharge passage 20*a* is communicated with main oil gallery M/G that supplies a lubricating oil to parts, for instance, slide portions of the engine, on a downstream side of filter 50. Oil pump 20 is provided with flow control valve 51 that controls a flow amount of the working fluid to an appropriate flow amount, for example, such that an excessive amount of the working fluid is discharged from discharge passage 20*a* to oil pan 23.

The electronic controller includes a computer that receives information signals outputted from various sensors (not shown) such as a crank angle sensor that detects engine revolution number, an air flow meter, an engine coolant temperature sensor, an engine temperature sensor, a throttle position sensor, and a cam angle sensor that detects a rotation phase of camshaft 2, and determines an operating condition of the engine. The electronic controller is configured to control operating positions of the spools of first electromagnetic valve 21 and second electromagnetic valve 36 as explained later so as to carry out changeover of the above-described respective fluid passages by applying pulse current to respective electromagnetic coils of first and second electromagnetic valves 21, 36.

Position holding mechanism 5 serves to hold vane rotor 9 in a predetermined intermediate phase position as shown in FIG. 3 between a maximum phase-retard position as shown in FIG. 4 and a maximum phase-advance position as shown in FIG. 5 with respect to housing 7.

As shown in FIG. 1 to FIG. 6, position holding mechanism 5 includes first and second lock pin engaging members 28*a*, 28*b* provided in sprocket 1, first and second lock holes (i.e., lock concave portions) 24, 25 formed in first and second lock pin engaging members 28*a*, 28*b*, and first and second lock pins (i.e., lock members) 26, 27 coming into engagement with first and second lock holes 24, 25 and disengagement therefrom, and second hydraulic circuit 6 (see FIG. 1) that serves to unlock respective lock pins 26, 27 from respective lock holes 24, 25. First and second lock pin engaging members 28*a*, 28*b* respectively have generally annular shapes, and are disposed in a position on axial end surface 1*c* of sprocket 1 which is opposed to large-diameter portion 15*e* of rotor 15 of vane rotor 9. First and second lock pins 26, 27 are disposed in large-diameter portion 15*e* of rotor 15.

As shown in FIG. 2 to FIG. 6, first lock hole 24 is provided in the form of an elongated groove extending along the circumferential direction of sprocket 1, and opened to an upper surface of first lock pin engaging member 28*a* which is flushed with axial end surface 1*c* of sprocket 1. First lock hole 24 has a generally oval shape as indicated by a broken line shown in FIG. 3. First lock hole 24 has a depth stepwise increasing from the phase-retard side toward the phase-advance side. Specifically, first lock hole 24 is defined by a stepwise bottom surface, and a peripheral side surface extending from the bottom surface to the upper surface of first lock pin engaging member 28*a*. The stepwise bottom surface includes first bottom surface 24*a* on the phase-retard side and second bottom surface 24*b* on the phase-advance side. The side surface includes first and second side surfaces 24*d*, 24*e* located on the phase-retard side which respectively extend uprightly from first and second bottom surfaces 24*a*, 24*b*, and side surface 24*c* located on the phase-advance side which extends upright from second bottom surface 24*b*. First bottom surface 24*a* has an area smaller than that of a tip axial end surface of first lock pin 26. Second bottom surface 24*b* is elongated in the circumferential direction of sprocket 1 (i.e., in the phase-advance direction), and has an area larger than that of a tip axial end surface of first lock pin 26. One end position of second bottom surface 24*b* is located corresponding to a rotational position of vane rotor 9 which is offset from the maximum phase-retard position toward the phase-advance side.

First lock hole 24 and second lock hole 25 are concentrically arranged about an axis of sprocket 1 and disposed adjacent to each other with a clearance therebetween in the circumferential direction of sprocket 1. Second lock hole 25 has a circular shape when viewed in a direction perpendicular to a central axis (i.e., a rotation axis) of vane rotor 9, and extends through second lock pin engaging member 28*b*. One end of second lock hole 25 is opened to an upper surface of second lock pin engaging member 28*b* which is flushed with axial end surface 1*c* of sprocket 1. Second lock hole 25 is defined by bottom surface 25*a* and a peripheral side surface 25*b* extending uprightly from bottom surface 25*a*. Bottom surface 25*a* is formed into a stepless flat plane, and located corresponding to a rotational position of vane rotor 9 which is offset from the phase-advance position toward the phase-retard side. Second lock hole 25 has an inner diameter smaller than an outer diameter of a tip end portion of second lock pin 27, so that second lock pin 27 can be slightly moveable from the phase-retard side toward the phase-advance side while being engaged in second lock hole 25 with a clearance therebetween in a circumferential direction thereof.

First lock hole 24 and second lock hole 25 also serve as unlock pressure-apply chambers into which a working fluid pressure is introduced through second hydraulic circuit 6. The fluid pressure introduced into respective lock holes 24, 25 acts on the tip axial end surfaces of first and second lock pins 26, 27 and first and second step surfaces (i.e., pressure receiving surfaces) 26*c*, 27*c* respectively formed on first and second lock pins 26, 27 as explained later.

As shown in FIG. 1 and FIG. 5, first lock pin 26 includes pin body 26*a*, tip end portion 26*b* disposed on a side of one end of pin body 26*a*, and first step surface 26*c* disposed between pin body 26*a* and tip end portion 26*b*. Pin body 26*a* is slidably disposed within first pin hole 31*a* extending through large-diameter portion 15*e* of rotor 15 along the axial direction of rotor 15. Tip end portion 26*b* has a diameter smaller than that of pin body 26*a*, and is integrally formed with pin body 26*a* and connected therewith through first step surface 26*c*.

Pin body 26*a* has a cylindrical shape having an axial bore, and a cylindrical outer peripheral surface that straightly extends and slidably moves while coming into hermetical contact with an inner peripheral surface that defines first pin hole 31*a* of rotor 15. On the other hand, tip end portion 26*b* has a generally cylindrical shape having a relatively small outer diameter smaller than an inner diameter of first lock hole 24.

First lock pin 26 is biased in such a direction that first lock pin 26 is engaged in first lock hole 24 by first spring 29 as a biasing member which is installed between a bottom surface of the axial bore of pin body 26*a* and an inner surface of front cover 13 which is opposed to rotor 15.

First step surface 26*c* has an annular shape, and serves as a pressure receiving surface on which the working fluid pressure introduced into first pin hole 31*a* through communication passage 39 as explained later is exerted. First step surface 26*c* urges first lock pin 26 to retreat from first lock hole 24 against the spring force of first spring 29 and move to an unlock position thereof.

Further, front cover 13 has first air vent 32*a* formed on a side of first pin hole 31*a* of rotor 15. First air vent 32*a* extends through front cover 13, and serves to ensure a smooth sliding movement of first lock pin 26.

Further, when vane rotor 9 is rotated from the maximum phase-retard position as shown in FIG. 4 to the maximum phase-advance position as shown in FIG. 5, an end surface of tip end portion 26*b* of first lock pin 26 is stepwise engaged with respective bottom surfaces 24*a*, 24*b* of first lock hole 24 and then slides on second bottom surface 24*b* as shown in FIG. 6 to FIG. 9. Finally, an outer peripheral surface of tip end portion 26*b* is contacted with side surface 24*c* located on the phase-advance side, thereby restraining further rotation of vane rotor 9 in the phase-advance direction. This operation will be specifically explained later.

Second lock pin 27 has substantially same configuration (i.e., an outer diameter and an axial length) as that of first lock pin 26. Second lock pin 27 includes pin body 27*a*, tip end portion 27*b* disposed on a side of one end of pin body 27*a*, and second step surface 27*c* disposed between pin body 27*a* and tip end portion 27*b*. Pin body 27*a* is slidably disposed within second pin hole 31*b* to be spaced apart from first pin hole 31*a* in the circumferential direction of rotor 15 and extending through large-diameter portion 15*e* of rotor 15 along the axial direction of rotor 15. Tip end portion 27*b* has a diameter smaller than that of pin body 27*a*, and is integrally formed with pin body 27*a* and connected therewith through second step surface 27*c*.

Pin body 27*a* has a cylindrical shape having an axial bore, and a cylindrical outer peripheral surface that straightly extends and slidably moves while coming into hermetical contact with an inner peripheral surface that defines second pin hole 31*b* of rotor 15. On the other hand, tip end portion 27*b* has a generally cylindrical shape having a relatively small outer diameter smaller than an inner diameter of second lock hole 25.

Second lock pin 27 is biased in such a direction that second lock pin 27 is engaged in second lock hole 25 by first spring 30 as a biasing member which is installed between a bottom surface of the axial bore of pin body 27*a* and the inner surface of front cover 13.

Second step surface 27*c* has an annular shape, and serves as a pressure receiving surface on which the working fluid pressure introduced into second pin hole 31*b* through communication passage 39 as explained later is exerted. Second step surface 27*c* urges second lock pin 27 to retreat from second lock hole 25 against the spring force of second spring 30 and move to an unlock position thereof.

Front cover 13 has second air vent 32*b* formed on a side of second pin hole 31*b* of rotor 15. Second air vent 32*b* extends through front cover 13, and serves to ensure a smooth sliding movement of second lock pin 27.

Further, when vane rotor 9 is rotated from the maximum phase-retard position as shown in FIG. 4 to the maximum phase-advance position as shown in FIG. 5, tip end portion 27*b* of second lock pin 27 slides on axial end surface 1*c* of sprocket 1 and is engaged in second lock hole 25 so that an end surface of tip end portion 27*b* is resiliently contacted with bottom surface 25*a* as shown in FIG. 6 to FIG. 9. At this time, an outer peripheral surface of tip end portion 27*b* is contacted with a phase-retard side of side surface 25*b*, thereby restraining rotation of vane rotor 9 in the phase-retard direction.

Figure 9:
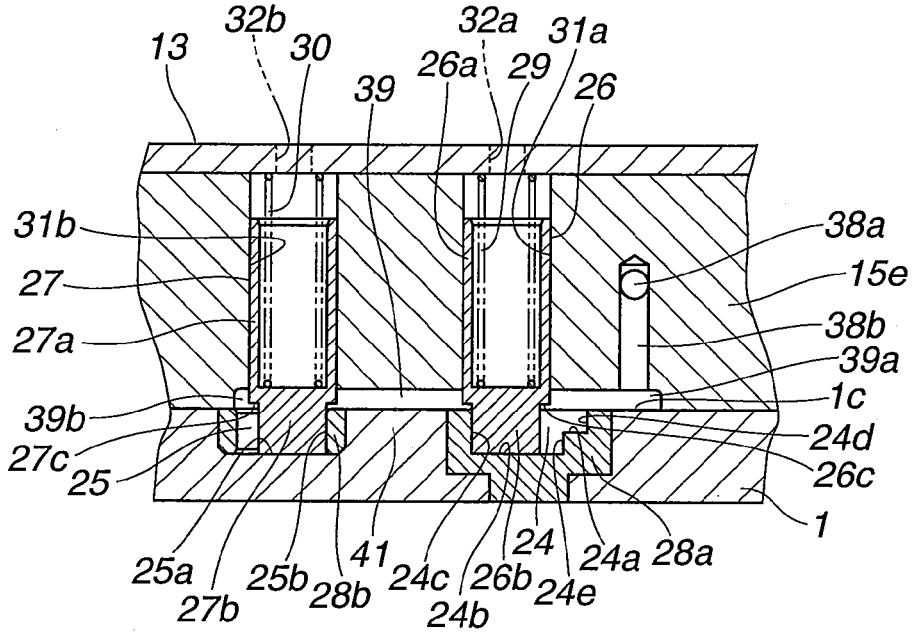
FIG. 9 is a cross-section taken along line B-B shown in FIG. 3, which shows the lock pins when the vane rotor is rotationally further moved from the respective positions shown in FIG. 8 toward the phase-advance side and placed in the intermediate phase position.
Figure 10:
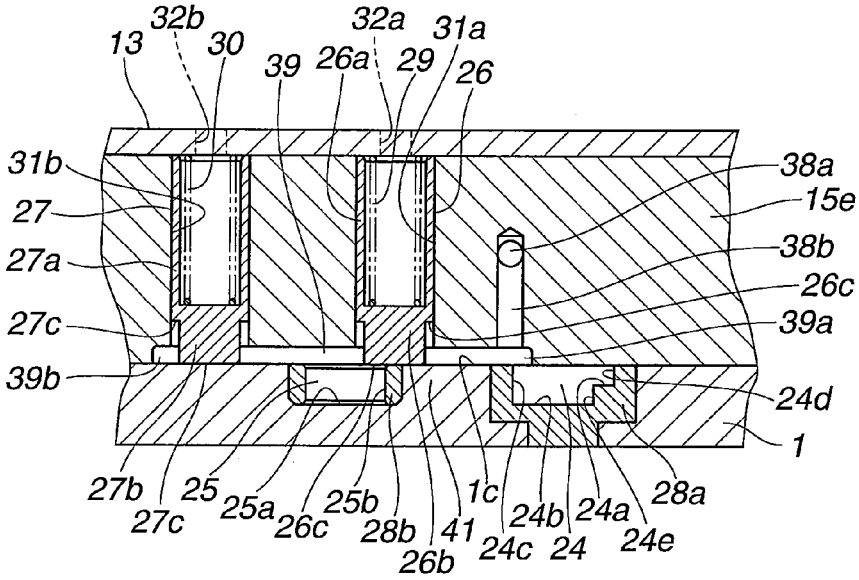
FIG. 10 is a cross-section taken along line B-B shown in FIG. 3, which shows the lock pins when the vane rotor is held in the maximum phase-advance position.

As shown in FIG. 9, when first lock pin 26 and second lock pin 27 are in engagement in first lock hole 24 and second lock hole 25, respectively, the outer peripheral surface of tip end portion 24*b* of first lock pin 26 and the outer peripheral surface of tip end portion 27*b* of second lock pin 27 are in contact with side surface 24*c* of first lock hole 24 and side surface 25*b* of second lock hole 25, respectively. Accordingly, first lock pin 26 and second lock pin 27 cooperate with each other to sandwich partition wall portion 41 disposed between first and second lock holes 24, 25 therebetween, thereby restraining free rotation of vane rotor 9 toward both the phase-advance side and the phase-retard side.

That is, first and second lock pins 26, 27 are simultaneously engaged in the corresponding first and second lock holes 24, 25, respectively, so that vane rotor 9 can be restrained from rotating relative to housing 7 and held in the intermediate phase position between the maximum phase-retard phase position and the maximum phase-advance phase position.

Further, as shown in FIG. 9, when respective lock pins 26, 27 are in engagement in respective lock holes 24, 25, first and second step surfaces 26*c*, 27*c* are located in a position slightly upper than peripheral edges of an open end of respective lock holes 24, 25, that is, located on the side of large-diameter portion 15*e* of rotor 15 beyond the peripheral edges of an open end of respective lock holes 24, 25.

As shown in FIG. 1, second hydraulic circuit 6 includes supply/discharge passage 33, supply passage 34 branched from discharge passage 20*a* of oil pump 20, discharge passage 35 communicated with drain passage 22, and second electromagnetic valve 36. Second electromagnetic valve 36 is disposed between supply/discharge passage 33 and each of supply passage 34 and discharge passage 35, and operated to carry out selective changeover of fluid communication between supply/discharge passage 33 and one of supply passage 34 and discharge passage 35 in accordance with an engine operating condition. Supply-discharge passage 33 serves to supply the hydraulic pressure supplied from oil pump 20 to first and second lock holes 24, 25 through supply passage 34 and discharge the hydraulic pressure in first and second lock holes 24, 25 through discharge passage 35.

As shown in FIG. 1 and FIG. 2, supply/discharge passage 33 is communicated with respective lock holes 24, 25 through L-shaped bent passage portion 33*a* located on the side of one end of supply/discharge passage 33. Supply-discharge passage 33 is connected to second electromagnetic valve 36 on a side of the other end thereof. Supply-discharge passage 33 serves as an unlock passage through which the hydraulic pressure is supplied to respective lock holes 24, 25 to thereby unlock respective lock pins 26, 27 from respective lock holes 24, 25 as explained later. Passage portion 33*a* is formed in the one end portion of passage construction member 37. Passage portion 33*a* extends in the axial direction of passage construction member 37, and is bent in a radially outward direction of passage construction member 37 so as to be opened to the outer peripheral surface of passage construction member 37. The open end of passage portion 33*a* is located adjacent to the open end of phase-retard passage portion 18*a* of phase-retard fluid passage 18 in the axial direction of passage construction member 37 with a clearance therebetween. Passage portion 33*a* is communicated with respective lock holes 24, 25 through fluid passage 38 and communication passage 39 which are formed in rotor 15.

Passage construction member 37 includes a plurality of annular fitting grooves, for example, three grooves in FIG. 4, formed in an axially spaced relation to each other on the outer peripheral surface of passage construction member 37. A plurality of seal rings 40, for example, three seal rings in FIG. 1, are respectively fitted into the fitting grooves and seal a clearance between the open end of phase-retard passage portion 18*a* of phase-retard fluid passage 18 and the open end of passage portion 33*a* of supply/discharge passage 33 and a clearance between the open end of passage portion 33*a* and fluid chamber 19*b*.

Figure 6:
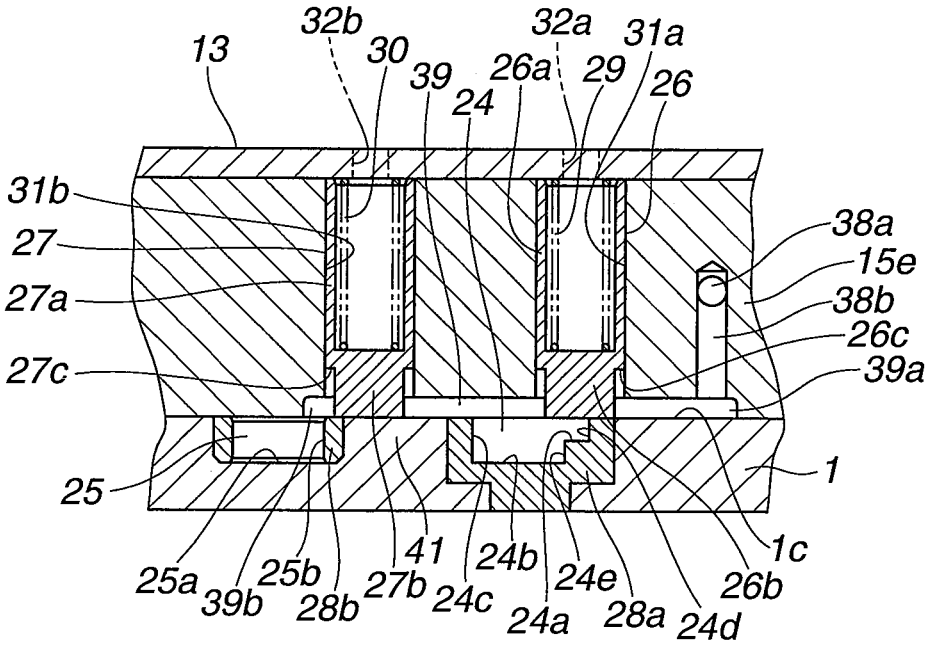
FIG. 6 is a cross-section taken along line B-B shown in FIG. 3, which shows lock pins when the vane rotor is held in the maximum phase-retard position.

As shown in FIG. 2, FIG. 3 and FIG. 6, fluid passage 38 includes radial passage portion 38*a* formed in the radial direction of rotor 15, and axial passage portion 38*b* formed in the axial direction of rotor 15 and connected to a substantially mid-portion of radial passage portion 38*a*. Radial passage portion 38*a* is formed by drilling so as to extend through rotor 15, and closed at an outer peripheral end portion by ball plug 38*c*.

As shown in FIG. 2 and FIG. 3, communication passage 39 is in the form of a generally arcuate groove or cutout formed on a rear surface of rotor 15. Communication passage 39 is formed in a position closer to an inner peripheral surface of large-diameter portion 15*e* of rotor 15, that is, in a position offset from centers of first and second lock holes 24, 25 toward the central axis of rotor 15 in the radial direction of rotor 15 when viewed in the direction perpendicular to the central axis of rotor 15.

Further, whenever vane rotor 9 is located in any rotational position relative to housing 7, communication passage 39 is exposed to first and second lock holes 24, 25 within an entire region extending between one end portion 39*a* and the other end portion 39*b* in the circumferential direction of rotor 15. Thus, communication passage 39 is always communicated with first and second lock holes 24, 25 and tip ends of first and second pin holes 31*a*, 31*b*. That is, whenever vane rotor 9 is located in any rotational position between the maximum phase-retard position and the maximum phase-advance position, communication passage 39 is always communicated with first and second lock holes 24, 25 and exposed to first and second step surfaces 26*c*, 27*c* as shown in FIG. 6 to FIG. 10. In addition, one end portion 39*a* of communication passage 39 is communicated with axial passage portion 38*b* of fluid passage 38.

Second electromagnetic valve 36 is a three-port two-position on-off valve. Second electromagnetic valve 36 is operated to selectively communicate supply/discharge passage 33 with one of supply passage 34 and discharge passage 35 by a on-off control current outputted from the electronic controller and a spring force of a valve spring which is applied to the spool of second electromagnetic valve 36.

An operation of valve timing control apparatus 100 according to this embodiment will be explained hereinafter.

In a case where an ignition switch is turned off to stop the engine, immediately before the engine is completely stopped, first electromagnetic valve 21 is supplied with control current outputted from the electronic controller such that the spool of first electromagnetic valve 21 is moved in an axial direction thereof so as to establish fluid communication between one of phase-retard fluid passage 18 and phase-advance fluid passage 19 and discharge passage 20*a* and fluid communication between the other of phase-retard fluid passage 18 and phase-advance fluid passage 19 and drain passage 22. That is, the electronic controller determines a rotational position of vane rotor 9 relative to housing 7 on the basis of information signals from the cam angle sensor and the crank angle sensor, and carries out supply of a hydraulic pressure to respective phase-retard hydraulic chambers 11 or respective phase-advance hydraulic chambers 12 on the basis of the determined rotational position of vane rotor 9. As a result, vane rotor 9 is allowed to rotationally move to the predetermined intermediate phase position as shown in FIG. 3 which is disposed between the maximum phase-retard position and the maximum phase-advance position.

At the same time, second electromagnetic valve 36 is energized to communicate supply/discharge passage 33 with discharge passage 35. As a result, the working fluid in first and second lock holes 24, 25 is flowed from supply/discharge passage 33 into discharge passage 35 and drain passage 22 through communication passage 39 and fluid passage 38, and then is discharged in oil pan 23. As a result, the hydraulic pressure in first and second lock holes 24, 25 becomes low, so that respective lock pins 26, 27 are biased by the spring forces of respective springs 29, 30 in a projection direction thereof in which respective lock pins 26, 27 project from respective pin holes 31*a*, 31*b*. Then, respective lock pins 26, 27 are brought into engagement in respective lock holes 24, 25 as shown in FIG. 9.

In this state, the outer peripheral surface of tip end portion 26*b* of first lock pin 26 is in contact with side surface 24*c* of first lock hole 24, so that a movement of first lock pin 26 in the phase-advance direction is restrained. On the other hand, the outer peripheral surface of tip end portion 27*b* of second lock pin 27 is in contact with the phase-retard side of side surface 25*b* of second lock hole 25, so that a movement of second lock pin 27 in the phase-retard direction is restrained.

As a result, vane rotor 9 is held in the predetermined intermediate phase position as shown in FIG. 3, in which a timing of closing the intake valve is controlled to a phase-advance side before a piston bottom dead center.

Accordingly, in a case where the engine is restarted at a cooling state after a sufficient time has elapsed from stop of the engine, the specific closing timing of the intake valve can serve to increase an effective compression ratio of the engine to thereby achieve better combustion of the engine and enhance stability of starting of the engine and startability of the engine.

After that, when the engine is shifted to an idling operation, first electromagnetic valve 21 is supplied with control current outputted from the electronic controller and moved to the position as shown in FIG. 1 in which fluid communication between phase-retard fluid passage 18 and discharge passage 20*a* is established and fluid communication between phase-advance fluid passage 19 and drain passage 22. On the other hand, at this time, second electromagnetic valve 36 is not supplied with control current outputted from the electronic controller, and is in the off position as shown in FIG. 1 in which fluid communication between supply/discharge passage 33 and supply passage 34 is established and fluid communication between supply/discharge passage 33 and discharge passage 35 is interrupted.

As a result, the hydraulic pressure discharged from oil pump 20 to discharge passage 20*a* is allowed to flow into communication passage 39 through supply passage 34, supply/discharge passage 33 and fluid passage 38 and then flow into respective lock holes 24, 25 and act on first and second step surfaces 26*c*, 27*c*. Accordingly, respective lock pins 26, 27 are urged to rearwardly retreat from respective lock holes 24, 25 and come into the unlock state against the spring forces of respective springs 29, 30. Thus, vane rotor 9 can be permitted to rotate.

A part of the hydraulic pressure discharged into discharge passage 20*a* is supplied to respective phase-retard hydraulic chambers 11 through phase-retard fluid passage 18 and first fluid passage 11*a*. On the other hand, the working fluid in respective phase-advance hydraulic chambers 12 is discharged to drain passage 22 through respective fluid passage 12*a* and phase-advance fluid passage 19 and then to oil pan 23.

Accordingly, the hydraulic pressure in respective phase-retard hydraulic chambers 11 becomes high, and the hydraulic pressure in respective phase-advance hydraulic chambers 12 becomes low. Therefore, as shown in FIG. 4, vane rotor 9 is rotated in a counterclockwise direction (i.e., in the phase-retard direction) so that one side surface of first vane 16*a* is contacted with the side surface of first shoe 10*a* which is opposed to the one side surface of first vane 16*a* to thereby restrain and hold vane rotor 9 in the maximum phase-retard position.

As a result, a valve overlap of the intake valve and the exhaust valve becomes zero to thereby suppress blowback of combustion gas, attain good combustion condition and serve for enhancing fuel economy and stabilizing engine revolution.

Further, when the engine is shifted to a high speed range, first electromagnetic valve 21 is supplied with the control current outputted from the electronic controller and moved to the position in which fluid communication between phase-advance fluid passage 19 and discharge passage 20*a* is established and fluid communication between phase-retard fluid passage 18 and drain passage 22. On the other hand, at this time, second electromagnetic valve 36 is held in the off position in which the fluid communication between supply/discharge passage 33 and supply passage 34 is established and the fluid communication between supply/discharge passage 33 and discharge passage 35 is interrupted.

Accordingly, the hydraulic pressure in respective phase-advance hydraulic chambers 12 becomes high, and the hydraulic pressure in respective phase-retard hydraulic chambers 11 becomes low. Therefore, as shown in FIG. 5, vane rotor 9 is rotated in a clockwise direction (i.e., in the phase-advance direction) so that the other side surface of first vane 16*a* is contacted with the side surface of second shoe 10*b* which is opposed to the other side surface of first vane 16*a* to thereby restrain and hold vane rotor 9 in the maximum phase-advance position. As a result, the opening timing of the intake valve is advanced to increase the valve overlap of the intake valve and the exhaust valve, so that an amount of intake air is increased to enhance an output of the engine.

Further, in a case where when the ignition switch is turned off to stop the engine as described above, vane rotor 9 is rotated and stopped in the maximum phase-retard position as shown in FIG. 4 and FIG. 6 without returning to the intermediate phase position between the maximum phase-retard position and the maximum phase-advance position where the engine is difficult to restart, the following operation is carried out at restart of the engine.

Figure 7:
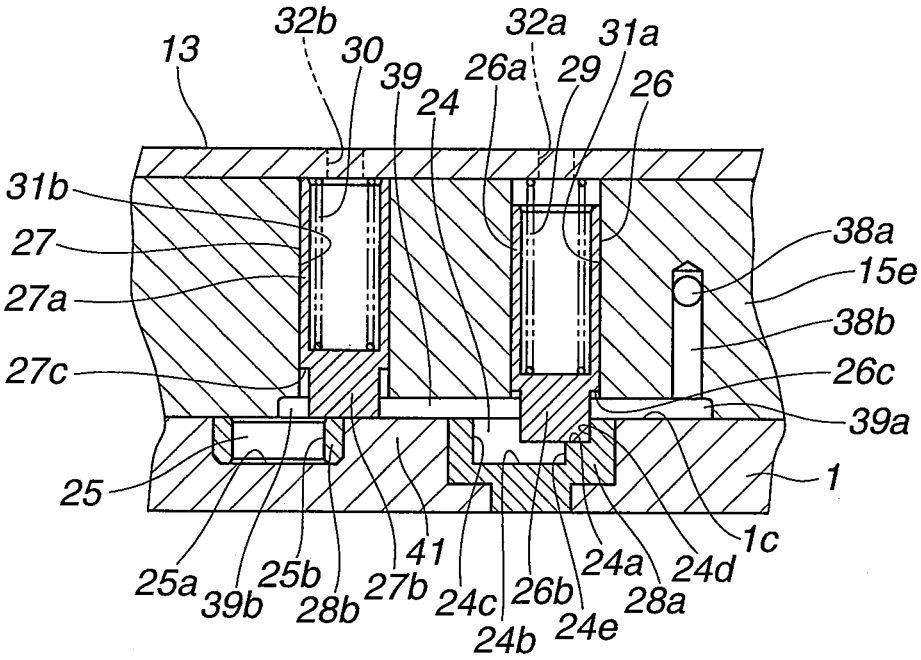
FIG. 7 is a cross-section taken along line B-B shown in FIG. 3, which shows the lock pins when the vane rotor is slightly rotationally moved from the maximum phase-retard position toward a phase-advance side.

When cranking is started by turning on the ignition switch, alternating torque (positive and negative torque) that is generated due to the spring force of the valve spring is inputted to camshaft 2 (i.e., vane rotor 9) at an initial stage of the cranking. When the negative torque of the varying torque is inputted to camshaft 2, vane rotor 9 is slightly rotated toward the phase-advance side. At this time, as shown in FIG. 7, first lock pin 26 is urged to move downward by the spring force of first spring 29 so that the end surface of tip end portion 26*b* comes into contact with first bottom surface 24*a* of first lock hole 24.

Figure 8:
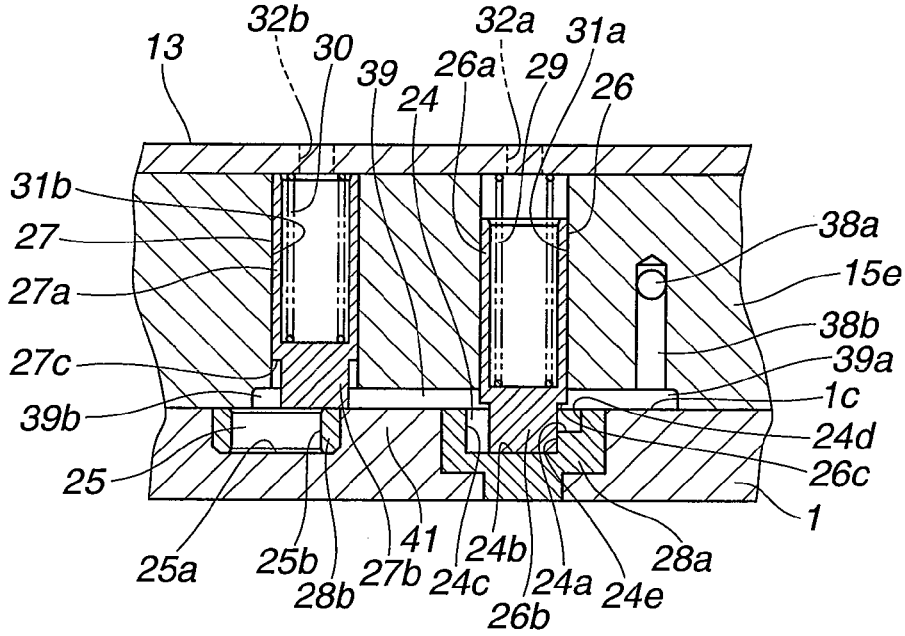
FIG. 8 is a cross-section taken along line B-B shown in FIG. 3, which shows the lock pins when the vane rotor is rotationally further moved from the respective positions shown in FIG. 7 toward the phase-advance side.

Immediately after that, when the positive torque is inputted to camshaft 2 to rotate vane rotor 9 toward the phase-retard side, the outer peripheral surface of tip end portion 26*b* of first lock pin 26 is contacted with first side surface 24*d* uprightly extending from the side of first bottom surface 24*a* of first lock hole 24 so that vane rotor 9 is prevented from rotating toward the phase-retard side. After that, when the negative torque is inputted to camshaft 2 again to rotate vane rotor 9 toward the phase-advance side, first lock pin 26 is urged to move downward by the spring force of first spring 29 so that the end surface of tip end portion 26*b* is contacted with second bottom surface 24*b* of first lock hole 24 as shown in FIG. 8.

Then, when the positive torque is inputted to camshaft 2 again, the outer peripheral surface of tip end portion 26*b* of first lock pin 26 is contacted with second side surface 24*e* uprightly extending from the side of second bottom surface 24*a* of first lock hole 24 so that vane rotor 9 is prevented from rotating toward the phase-retard side. That is, vane rotor 9 is rotated toward the phase-advance side by a function of a ratchet mechanism constituted of first lock pin 26 and first lock hole 24.

Subsequently, when vane rotor 9 is rotated toward the phase-advance side again by the negative torque, the end surface of tip end portion 26*b* of first lock pin 26 is slid on second bottom surface 24*b* of first lock hole 24 toward the phase-advance side and the outer peripheral surface of tip end portion 26*b* is contacted with side surface 24*c* of first lock hole 24 as shown in FIG. 9. At the same time, second lock pin 27 is engaged in second lock hole 25 so that the end surface of tip end portion 27*b* is contacted with bottom surface 25*a* of second lock hole 25, and the outer peripheral surface of tip end portion 27*b* is contacted with the phase-retard side of side surface 25*b* of second lock hole 25. Thus, partition wall portion 41 of sprocket 1 is sandwiched between tip end portion 26*b* of first lock pin 26 and tip end portion 27*b* of second lock pin 27. Accordingly, vane rotor 9 is held in the intermediate phase position between the maximum phase-retard position and the maximum phase-advance position and restrained from rotating toward both the phase-retard side and the phase-advance side.

As a result, at normal starting condition of the engine, effective compression ratio during cranking can be increased to achieve good combustion and enhance starting stability and startability of the engine.

As explained above, in this embodiment, first step surface 26*c* of tip end portion 26*b* of first lock pin 26 and second step surface 27*c* of tip end portion 27*b* of second lock pin 27 respectively serve as a pressure-receiving surface that is used for unlocking respective lock pins 26, 27 from respective lock holes 24, 25. With this construction, the outer peripheral surface of respective lock pins 26, 27 can be formed into a generally cylindrical shape, and it is not necessary to provide a flange portion on a lock pin as proposed in the conventional art. Therefore, outer diameters of respective lock pins 26, 27 can be reduced as small as possible, thereby serving for downsizing rotor 15 and the whole valve timing control apparatus 100. As a result, installability of valve timing control apparatus 100 within an engine room can be enhanced.

Further, communication passage 39 is formed such that even when vane rotor 9 is located in any rotational position, communication passage 39 is always communicated with respective lock holes 24, 25 and opposed to respective step surfaces 26*c*, 27*c* of respective lock pins 26, 27. With this construction, the hydraulic pressure supplied from oil pump 20 through supply/discharge passage 33 can be always applied to respective step surfaces 26*c*, 27*c* as well as the end surfaces of respective tip end portions 26*b*, 27*b* through respective lock holes 24, 25.

Since communication passage 39 is always communicated with respective lock holes 24, 25 in an entire region thereof, it is possible to suppress a change in volume of whole communication passage 39 extending from supply/discharge passage 33 to respective lock holes 24, 25. If there occurs the change in volume of whole communication passage 39, the hydraulic pressure in respective lock holes 24, 25 may be instantly dropped so that abrupt engagement of respective lock pins 26, 27 in respective lock holes 24, 25 is caused by the spring force of respective springs 29, 30.

However, in this embodiment, the change in volume of whole communication passage 39 can be sufficiently suppressed to thereby prevent instant drop of the hydraulic pressure in respective lock holes 24, 25 and therefore, inhibit abrupt engagement of respective lock pins 26, 27 in respective lock holes 24, 25. As a result, smooth changeover of a rotational direction of vane rotor 9 can be always attained, and a response to the changeover thereof can be enhanced.

Further, communication passage 39 is in the form of a single groove that extends between first and second lock holes 24, 25 and is elongated in the circumferential direction of rotor 15. Since communication passage 39 is formed in the position offset from the central axes of first and second lock holes 24, 25 toward the central axis of rotor 15 in the radial direction of rotor 15, a distance between axial passage portion 38*b* of fluid passage 38 and respective lock pins 26, 27 can be reduced to thereby serve for reducing a time required for disengagement of respective lock pins 26, 27 from respective lock holes 24, 25. Further, with the offset arrangement, an axial length of respective pin holes 31*a*, 31*b* can be comparatively elongated to thereby suppress inclination of respective lock pins 26, 27 during the sliding movement in respective pin holes 31*a*, 31*b*. As a result, when vane rotor 9 is located in the intermediate phase position (i.e., the intermediate lock position), a backlash of respective lock pins 26, 27 relative to respective pin holes 31*a*, 31*b* can be reduced.

Further, as explained above, under a condition where vane rotor 9 is held in the intermediate phase position, the outer peripheral surface of tip end portion 26*b* of first lock pin 26 is in contact with side surface 24*c* of first lock hole 24 to thereby restrain a movement of first lock pin 26 in the phase-advance direction, and the outer peripheral surface of tip end portion 27*b* of second lock pin 27 is in contact with the phase-retard side of side surface 25*b* of second lock hole 25 to thereby restrain a movement of second lock pin 27 in the phase-retard direction. Thus, respective lock pins 26, 27 are arranged to become close to each other in the circumferential direction of vane rotor 9, and therefore, a thickness of partition wall portion 41 of sprocket 1 can be increased as large as possible.

Specifically, in the intermediate phase position of vane rotor 9 as shown in FIG. 3 which is suitable for starting the engine in the cooling state, if first lock pin 26 and second lock pin 27 are arranged to become apart from each other in the circumferential direction of vane rotor 9, it is required to reduce a distance between first lock pin engaging member 28*a* (i.e. first lock hole 24) and second lock pin engaging member 28*b* (i.e. second lock hole 25) in the circumferential direction of vane rotor 9. For this reason, the thickness of partition wall portion 41 of sprocket 1 must be reduced. As a result, deterioration in strength of sprocket 1 is caused, and it may be prevented to form second lock hole 25 due to limitations of layout.

In contrast, in this embodiment with the above-described specific construction, it is possible to set the distance between first lock hole 24 and second lock hole 25 in the circumferential direction of vane rotor 9 to a sufficiently large extent. Therefore, a thickness of partition wall portion 41 of sprocket 1 can be increased to thereby enhance a strength of sprocket 1 and be free from limitations of layout.

Further, the open end of phase-retard passage portion 18*a* of phase-retard fluid passage 18 and the open end of phase-advance passage portion 19*a* of phase-advance fluid passage 19 are disposed apart from each other with a sufficient distance therebetween. With this arrangement, there occurs no adverse influence due to pulsation of the working fluid supplied into the open ends, thereby serving for minimizing the number of seal rings 40 that seal a clearance between the open ends.

Further, since axial passage portion 38*b* of fluid passage 38 is formed in a position where there occurs no influence on machining of vane rotor 9, it is possible to suppress deterioration in machining of vane rotor 9.

Furthermore, since respective lock pins 26, 27 are disposed in rotor 15, a thickness of respective vanes 16*a*-16*d* can be reduced to thereby increase a rotational angle of vane rotor 9 relative to housing 7.

Second Embodiment

Figure 11:
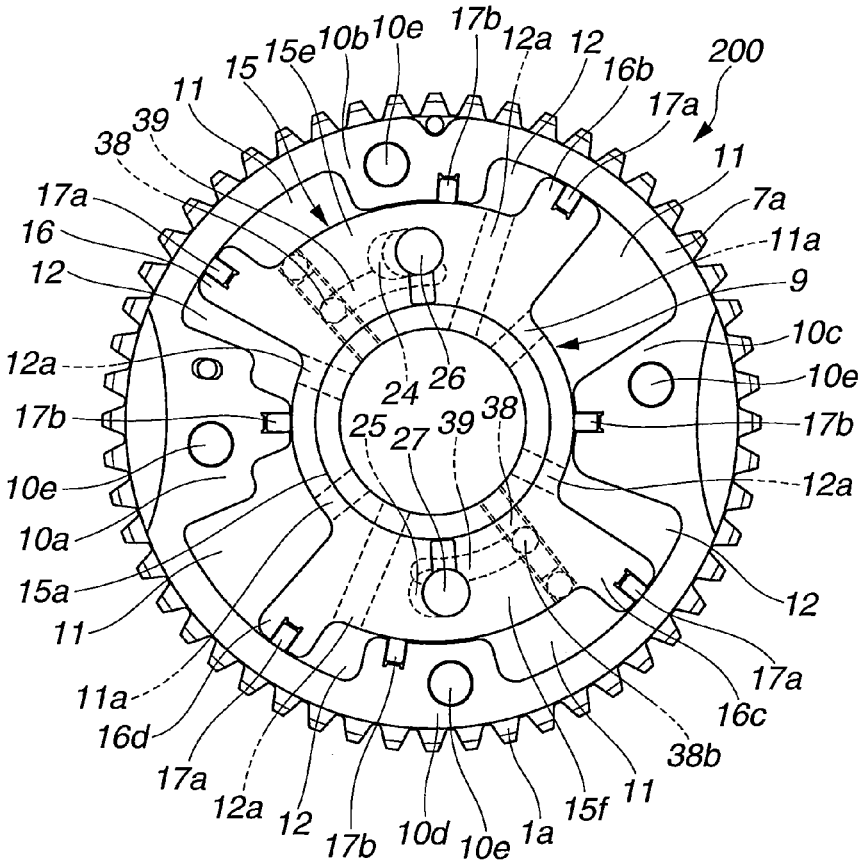
FIG. 11 is a cross-section similar to FIG. 3, but shows a vane rotor of the valve timing control apparatus according to a second embodiment of the present invention.

Referring to FIG. 11, there is shown a valve timing control apparatus according to a second embodiment of the present invention, in which first lock pin 26 and second lock pin 27 of position holding mechanism 5 are arranged in a diametrically opposed relation to each other with respect to the central axis of rotor 15.

As shown in FIG. 11, rotor 15 of valve timing control apparatus 200 includes first large-diameter portion 15*e* and second large-diameter portion 15*f* disposed diametrically opposed to first large-diameter portion 15*e*. First pin hole 31*a* is formed in first large-diameter portion 15*e*, and second pin hole 31*b* is formed in second large-diameter portion 15*f*. First and second lock pins 26, 27 are slidably disposed in respective pin holes 31*a*, 31*b*.

On the other hand, first and second lock holes 24, 25 engageable with first and second lock pins 26, 27 respectively are formed on axial end surface 1*c* of sprocket 1. First lock hole 24 is configured into the same shape as explained in the first embodiment, but second lock hole 25 is formed into a single long groove elongated in the circumferential direction of sprocket 1.

First and second large-diameter portions 15*e*, 15*f* are respectively formed with first and second fluid passages 38, 38 communicated with supply/discharge passage 33. First and second communication passages 39, 39 respectively communicated with first and second fluid passages 38, 38 are formed in positions in rotor 15 which are offset from first lock hole 24 and second lock hole 25 in the radially inward direction of rotor 15, respectively. Respective communication passages 39, 39 are formed into an arcuate shape, and always communicated with respective lock holes 24, 25, similarly to those in the first embodiment.

The configuration of respective lock pins 26, 27 and the construction of other parts are same as those in the first embodiment.

In the second embodiment, since first large-diameter portion 15*e* and second large-diameter portion 15*f* are formed in diametrically opposed relation to each other with respect to the central axis of rotor 15, a rotational balance of vane rotor 9 can be enhanced to thereby always attain smooth rotation of vane rotor 9 between the maximum phase-retard position and the maximum phase-advance position. Other functions and effects of the second embodiment are same as those of the first embodiment.

The valve timing control apparatus of the present invention is not limited to the above embodiments, and may be applied to not only the intake side of the engine but also the exhaust side thereof.

Further, the phase varying mechanism is not limited to the above embodiments using vane rotor 9, and may be applied to a phase varying mechanism in which a relative rotational phase of the sprocket and the intake-side camshaft is changed by using a helical gear.

Furthermore, the valve timing control apparatus of the present invention can be applied to a so-called idle-stop vehicle and a hybrid vehicle in which changeover of a drive source between an electric motor and an internal combustion engine is carried out according to a running mode of the vehicle.

This application is based on a prior Japanese Patent Application No. 2012-6655 filed on Jan. 17, 2012. The entire contents of the Japanese Patent Application No. 2012-6655 are hereby incorporated by reference.

Although the invention has been described above by reference to embodiments of the invention and modifications of the embodiments, the invention is not limited to the embodiments and modifications described above. Further variations of the embodiments and modifications described above will occur to those skilled in the art in light of the above teachings. The scope of the invention is defined with reference to the following claims.

What is claimed is:

1. A valve timing control apparatus for an internal combustion engine, comprising:

a housing to which a rotational force is transmitted from a crankshaft of the engine, the housing having shoes on an inner periphery thereof, a vane rotor fixed to a camshaft, the vane rotor cooperating with the shoes to define phase-advance hydraulic chambers and phase-retard hydraulic chambers therebetween, the vane rotor being rotatable relative to the housing toward a phase-advance side and a phase-retard side by a working fluid pressure that is selectively supplied to the phase-advance hydraulic chambers and the phase-retard hydraulic chambers and discharged therefrom, a first lock member and a second lock member respectively disposed on the vane rotor, the first lock member and the second lock member configured to be urged to project toward a side of the housing by a biasing member and allowed to retreat against a biasing force of the biasing member by a hydraulic pressure acting on a tip end portion of each of the first lock member and the second lock member, the hydraulic pressure being supplied separately from the working fluid pressure, a first lock concave portion disposed on the housing so as to be engaged with the tip end portion of the first lock member so as to restrain the vane rotor from being rotated from an intermediate phase position between a maximum phase-advance position and a maximum phase-retard position at least in a phase-advance direction;

a second lock concave portion disposed on the housing so as to be engaged with the tip end portion of the second lock member so as to restrain the vane rotor from being rotated from the intermediate phase position between the maximum phase-advance position and the maximum phase-retard position at least in a phase-retard direction; and a communication passage formed as a groove that is formed on an axial end surface of the vane rotor so as to extend along a circumferential direction of the vane rotor, the groove being open to the axial end surface of the vane rotor and always opposed to the first lock concave portion and the second lock concave portion so as to always establish fluid communication between the first lock concave portion and the second lock concave portion and introduce the hydraulic pressure to allow the first lock member and the second lock member to retreat from the first lock concave portion and the second lock concave portion against the biasing force of the biasing member, wherein even when the vane rotor is rotationally moved between the maximum phase-advance position and the maximum phase-retard position, the first lock concave portion and the second lock concave portion always communicate with each other via the groove.

2. The valve timing control apparatus as claimed in claim 1, wherein the first lock concave portion and the second lock concave portion are disposed adjacent to each other in a circumferential direction of the housing, and wherein the groove that the communication passage is formed as is a single groove elongated in the circumferential direction of the vane rotor, and the communication passage extends over the first lock concave portion and the second lock concave portion.

3. The valve timing control apparatus as claimed in claim 2, wherein the communication passage is disposed so as to be offset from centers of the first and second lock concave portions toward a central axis of the vane rotor in a radial direction of the vane rotor when viewed in a direction perpendicular to the central axis of the vane rotor.

4. The valve timing control apparatus as claimed in claim 3, wherein the communication passage is disposed offset from central axes of the first and second lock members toward the central axis of the vane rotor in the radial direction of the vane rotor.

5. The valve timing control apparatus as claimed in claim 2, wherein the vane rotor comprises:

a rotor disposed on a central side of the vane rotor, and a vane outwardly extending from on an outer periphery of the rotor in a radial direction of the rotor, the rotor comprising a radial passage extending along the radial direction of the rotor and an axial passage extending from the radial passage in an axial direction of the vane rotor, the axial passage being communicated with the communication passage.

6. The valve timing control apparatus as claimed in claim 5, wherein the axial passage is communicated with one end portion of the communication passage.

7. The valve timing control apparatus as claimed in claim 5, further comprising:

a passage construction member configured to be inserted into an insertion hole formed in the rotor, wherein the passage construction member is configured to supply the working fluid pressure to the phase-advance hydraulic chambers and the phase-retard hydraulic chambers and to supply the hydraulic pressure to the radial passage of the rotor.

8. The valve timing control apparatus as claimed in claim 7, wherein the passage construction member comprises:

a first passage extending in an axial direction of the passage construction member and having one open end communicated with the phase-advance hydraulic chambers, an unlock passage having one open end opened to an outer peripheral surface of the passage construction member and communicated with the radial passage of the rotor, and a second passage having one open end that is opened to the outer peripheral surface of the passage construction member adjacent to the one open end of the unlock passage in the axial direction of the passage construction member and communicated with the phase-retard hydraulic chambers.

9. The valve timing control apparatus as claimed in claim 8, wherein a seal ring is disposed between the open ends of the first and second passages of the passage construction member which are located adjacent to each other in the axial direction of the passage construction member.

10. The valve timing control apparatus as claimed in claim 1, wherein the first lock member and the second lock member are formed so as to be cylindrical.

11. The valve timing control apparatus as claimed in claim 1, wherein the first lock member and the second lock member are moveable in a direction of a rotation axis of the vane rotor.

12. The valve timing control apparatus as claimed in claim 5, wherein the first lock member and the second lock member are disposed in the rotor.

13. The valve timing control apparatus as claimed in claim 12, wherein the vane rotor comprises:

a plurality of vanes, and a large-diameter portion disposed between predetermined vanes among the plurality of vanes which are located adjacent to each other in a circumferential direction of the rotor, wherein the first lock member and the second lock member are disposed in the large-diameter portion.

14. The valve timing control apparatus as claimed in claim 1, wherein the first lock concave portion has a depth stepwise increasing from the phase-retard side toward the phase-advance side, the first lock concave portion comprising a stepwise bottom surface.

15. A valve timing control apparatus for an internal combustion engine, comprising:

a housing to which a rotational force is transmitted from a crankshaft of the engine, the housing having shoes on an inner periphery thereof, a vane rotor fixed to a camshaft, the vane rotor cooperating with the shoes to define phase-advance hydraulic chambers and phase-retard hydraulic chambers therebetween, the vane rotor being rotatable relative to the housing toward a phase-advance side and a phase-retard side by a working fluid pressure that is selectively supplied to the phase-advance hydraulic chambers and the phase-retard hydraulic chambers and discharged therefrom, a lock mechanism disposed on the vane rotor, the lock mechanism being constructed to lock the vane rotor relative to the housing in an intermediate phase position between a maximum phase-advance position and a maximum phase-retard position by a biasing member and unlock the vane rotor against a biasing force of the biasing member by a hydraulic pressure supplied separately from the working fluid pressure, and a communication passage through which a hydraulic pressure sufficient to unlock the vane rotor is provided to the lock mechanism even when the vane rotor is rotationally moved between the maximum phase-advance position and the maximum phase-retard position, the communication passage being formed as a groove that is formed on an axial end surface of the vane rotor so as to extend along a circumferential direction of the vane rotor, the groove being open to the axial end surface of the vane rotor and always opposed to the lock mechanism such that the hydraulic pressure is provided to the lock mechanism through the groove.

16. A valve timing control apparatus for an internal combustion engine, comprising:

a drive rotation member to which a rotational force is transmitted from a crankshaft of the engine;

a driven rotation member fixed to a camshaft, the driven rotation member cooperating with the drive rotation member to define phase-advance hydraulic chambers and phase-retard hydraulic chambers therebetween, the driven rotation member being rotatable relative to the drive rotation member toward a phase-advance side and a phase-retard side by a working fluid pressure that is selectively supplied to the phase-advance hydraulic chambers and the phase-retard hydraulic chambers and discharged therefrom, a lock member disposed on the driven rotation member, the lock member configured to be urged to project toward a side of the drive rotation member by a biasing member and allowed to retreat against a biasing force of the biasing member by a hydraulic pressure acting on a tip end portion of the lock member, the hydraulic pressure being supplied separately from the working fluid pressure, a lock concave portion disposed on the drive rotation member so as to be engaged with the tip end portion of the lock member so as to restrain the driven rotation member from being rotated from an intermediate phase position between a maximum phase-advance position and a maximum phase-retard position in at least a phase-retard direction; and a communication passage that is formed as a groove formed on an axial end surface of the driven rotation member so as to extend along a circumferential direction of the driven rotation member, the groove being open to the axial end surface of the driven rotation member and always opposed to the lock concave portion so as to introduce a hydraulic pressure to hold the lock member in a retreat state to the lock concave portion even when the driven rotation member is rotationally moved from the maximum phase-retard position to the maximum phase-advance position.

* * * * *